US010087655B2

(12) United States Patent
Pankratius et al.

(10) Patent No.: US 10,087,655 B2
(45) Date of Patent: Oct. 2, 2018

(54) CYLINDER LOCK

(71) Applicant: ABUS August Bremicker Söhne KG, Wetter-Volmarstein (DE)

(72) Inventors: Ernst Pankratius, Wetter (DE); Gerhard Meckbach, Hagen (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 122 days.

(21) Appl. No.: 15/316,318

(22) PCT Filed: Jun. 12, 2015

(86) PCT No.: PCT/EP2015/063126
§ 371 (c)(1),
(2) Date: Dec. 5, 2016

(87) PCT Pub. No.: WO2015/189367
PCT Pub. Date: Dec. 17, 2015

(65) Prior Publication Data

US 2017/0254113 A1 Sep. 7, 2017

(30) Foreign Application Priority Data

Jun. 13, 2014 (DE) ..... 10 2014 108 355

(51) Int. Cl.
*E05B 29/00* (2006.01)
*E05B 27/00* (2006.01)

(52) U.S. Cl.
CPC ..... *E05B 29/0066* (2013.01); *E05B 29/0013* (2013.01); *E05B 29/0053* (2013.01); *E05B 27/0082* (2013.01)

(58) Field of Classification Search
CPC .. E05B 29/00; E05B 29/0013; E05B 29/0033; E05B 29/004; E05B 29/0053;
(Continued)

(56) References Cited

U.S. PATENT DOCUMENTS 1,965,336 A * 7/1934 Fitz Gerald ..... E05B 29/00 70/421
2,660,876 A * 12/1953 Spain ..... E05B 29/00 70/495

(Continued)

FOREIGN PATENT DOCUMENTS

DE 3036262 A1 4/1982
FR 2079573 A5 11/1971

OTHER PUBLICATIONS

Pulford, High-Security Mechanical Locks, Oct. 17, 2007, pp. 191-194, Butterworth-Heinemann, United Kingdom.

*Primary Examiner* — Christopher J Boswell
(74) *Attorney, Agent, or Firm* — Dinsmore & Shohl LLP

(57) ABSTRACT

A cylinder lock comprises a cylinder housing (11) and a cylinder core (13) which is rotatably mounted in the cylinder housing. A plurality of plate tumblers (21) are provided in the cylinder core, wherein each of the plurality of plate tumblers is movable between a locking position and an unlocking position. At least one of the plurality of plate tumblers has a bolt-receiving depression (47). The cylinder lock further comprises at least one bolt element (27) which has a bolt tip (35), wherein the bolt element is movable between a blocking position and a release position. In the release position, the bolt tip engages in the bolt-receiving depression of the plate tumbler. The plate tumbler has, adjacent to the bolt-receiving depression, at least one bolt latch-in depression (45) in which the bolt tip of the bolt element engages in a latching manner when the at least one plate tumbler is moved out of the unlocking position, wherein the bolt latch-in depression is less deep than the bolt-receiving depression.

16 Claims, 7 Drawing Sheets

(58) Field of Classification Search
CPC .... E05B 29/006; E05B 27/00; E05B 27/0017; E05B 27/0021; E05B 27/005; E05B 27/0078; E05B 27/0082
See application file for complete search history.

(56) References Cited

U.S. PATENT DOCUMENTS

| | | | | | |
|---|---|---|---|---|---|
| 3,035,433 | A | | 5/1962 | Testa | |
| 3,479,848 | A | * | 11/1969 | Golden | E05B 29/00 70/377 |
| 3,597,948 | A | * | 8/1971 | Johnstone | E05B 29/00 70/406 |
| 3,990,282 | A | * | 11/1976 | Sorum | E05B 29/00 70/377 |
| 4,015,458 | A | * | 4/1977 | Mercurio | E05B 29/00 70/377 |
| 4,185,482 | A | | 1/1980 | Nail | |
| 4,750,342 | A | | 6/1988 | Nakai | |
| 5,611,225 | A | * | 3/1997 | Resch | E05B 17/0062 70/422 |
| 5,709,115 | A | * | 1/1998 | Richter | E05B 17/2084 70/417 |
| 6,523,381 | B1 | * | 2/2003 | Ritz | E05B 29/00 70/492 |
| 6,755,063 | B2 | * | 6/2004 | Takadama | E05B 29/004 70/383 |
| 6,959,569 | B2 | | 11/2005 | Strader et al. | |
| 6,978,647 | B2 | | 12/2005 | Edwards, Jr. et al. | |
| 7,225,651 | B2 | | 6/2007 | Edwards et al. | |
| 7,392,677 | B1 | * | 7/2008 | Fan | E05B 29/00 70/377 |
| 8,261,588 | B2 | | 9/2012 | Sabata | |
| 8,695,390 | B2 | | 4/2014 | Ng et al. | |
| 9,447,607 | B2 | * | 9/2016 | Malinen | E05B 21/066 |
| 2006/0032280 | A1 | | 2/2006 | Edwards et al. | |

* cited by examiner

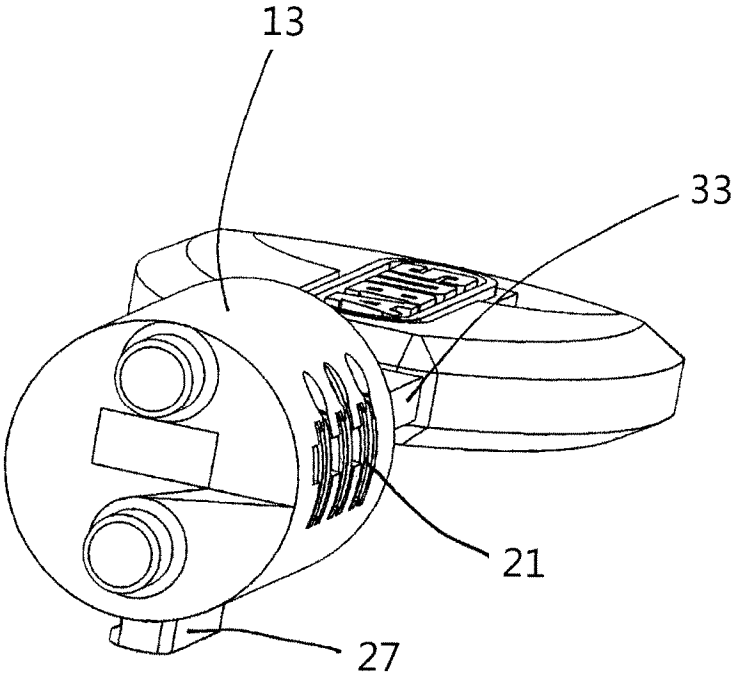
Fig. 2b
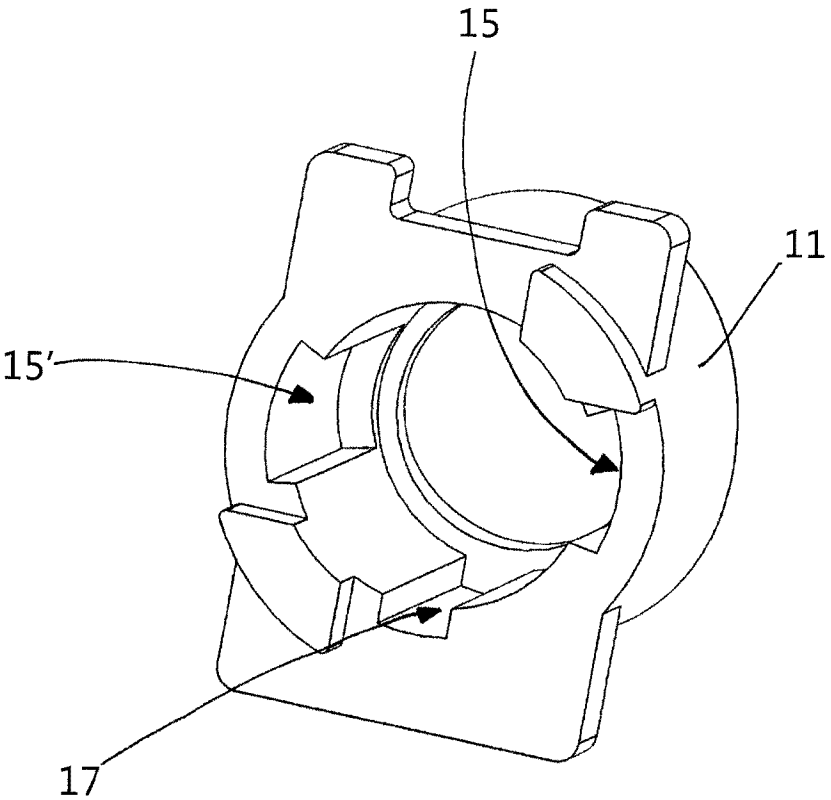
Fig. 2a
Fig. 2

CYLINDER LOCK

CROSS-REFERENCE TO RELATED APPLICATIONS

This application is the U.S. National Phase of PCT/EP2015/063126 filed Jun. 12, 2015, which claims priority of German Patent Application 10 2014 108 355.5 filed Jun. 13, 2014.

The invention relates to a cylinder lock having a cylinder housing and having a cylinder core rotatably supported in the cylinder housing, wherein the cylinder housing has at least one tumbler blocking recess and a latch blocking recess. A plurality of disk tumblers are provided in the cylinder core, wherein each of the plurality of disk tumblers has an engagement section and is movable between a latched position and an unlatched position. In the latched position, the engagement section of the respective disk tumbler engages into the tumbler blocking recess of the cylinder housing. In the unlatched position, the engagement section is brought out of engagement with the tumbler blocking recess. At least one of the plurality of disk tumblers has a latch reception recess. The cylinder lock furthermore comprises at least one latch element which has a latch tip and a blocking section, wherein the latch element is movable between a blocking position and a release position and is preloaded into the release position. In the blocking position, the blocking section of the latch element engages into the latch blocking recess of the cylinder housing. In the release position, the latch tip engages into the latch reception recess of the at least one disk tumbler and the blocking section is brought out of engagement with the latch blocking recess of the cylinder housing.

In such a cylinder lock, the disk tumblers and the latch element serve in their respective base position (latched position or blocking position in the latched state of the cylinder lock) to latch the cylinder core against a rotational movement relative to the cylinder housing. Only when an associated (i.e. a correctly encoded) key is introduced into the cylinder core through the key introduction openings of the disk tumblers can the cylinder core be rotated in a rotary direction of opening by means of the key.

A problem with such a cylinder lock is the so-called lock picking. This is understood as the attempt to open a cylinder lock manipulatively, i.e. without the associated key, without force. For this purpose, special opening tools are used with which the disk tumblers are displaced from their respective latched position against their preload direction up to and into their respective unlatched position, while a torque is simultaneously exerted onto the cylinder core in a rotary direction of opening. In accordance with a method ("setting" the disk tumblers), the disk tumblers are displaced after one another so that ultimately all disk tumblers are caught at the edge of the tumbler blocking recess of the cylinder housing and the cylinder core can finally be rotated further in the rotary direction of opening. In accordance with another method (probing the codings), the respective unlatched position is identified by a changed resistance on the displacement of the disk tumbler against the respective preload direction, with the changed resistance being able to manually probed by means of a suitable tool and/or being able to be acoustically recognized. Due to the thus determined displacement paths which the disk tumblers cover between the respective latched position and unlatched position, a correspondingly encoded key can be copied which can the open the cylinder lock without damage.

Cylinder locks of the above-explained kind are disclosed in the patent specifications U.S. Pat. No. 1,965,336, U.S. Pat. No. 4,185,482 and U.S. Pat. No. 6,978,647 B2. A lock-picking tool is additionally disclosed in the patent specification U.S. Pat. No. 6,978,647 B2 which can be used for the above-explained lock picking. A cylinder lock having a pivotable latch element is disclosed in patent specification U.S. Pat. No. 8,695,390 B2 which engages, adjacent to a latch reception recess, into a toothed zone of the respective disk tumbler to latch the disk tumbler against a movement when a torque is exerted onto the cylinder core in a rotary direction of opening. While such cylinder locks have proved themselves in practice and a high degree of protection against manipulations has already been reached, there is a need to increase the security against lock picking even further in cylinder locks having disk tumblers.

It is thus an object of the invention to provide a cylinder lock which has an improved security against manipulation, in particular with respect to the explained lock picking in accordance with the method of probing the codings of the disk tumblers.

This object is satisfied by a cylinder lock having the features of claim 1 and in particular in that the named at least one disk tumbler, which has a latch reception recess, has, adjacent to the latch reception recess, at least one latch catching recess into which the latch tip of the latch element catchingly engages when the at least one disk tumbler is displaced by a first path length from the unlatched position, wherein the latch catching recess is less deep than the latch reception recess of the disk tumbler.

In the cylinder lock in accordance with the invention, a rotation of the cylinder core is prevented in the closed state by two latching mechanisms explained in the following. On the one hand, a respective engagement section of the disk tumblers engages into a tumbler blocking recess of the cylinder housing in their latched position, wherein the disk tumblers are preferably preloaded into the latched position along a respective first preload direction. On the other hand, a blocking section of at least one latch element engages into a latch blocking recess of the cylinder housing in its blocking position, wherein the latch element is preferably preloaded into a release position along a second preload direction. Only when all disk tumblers are in the respective unlatched position, i.e. out of engagement with the tumbler blocking recess, and when the latch element is in the release position, i.e. out of engagement with the latch blocking recess, is the cylinder core freely rotatable in the cylinder housing. In this state, the latch element engages into a latch reception recess of the respective disk tumbler which is preferably provided at a longitudinal side of the disk tumbler.

On the lock-picking according to the method of the probing of the codings, the respective unlatched position of the disk tumbler is identified, as explained, by a changed resistance on the displacement of the disk tumbler. Such a changed movement resistance in particular occurs when the respective disk tumbler moves into the unlatched position and the latch element thus engages due to its preload into the latch reception recess of the disk tumbler (completely or only partly, the latter if all the disk tumblers associated with the latch element are not yet in their unlatched position). This changed resistance on the displacement of the disk tumbler will be called a first change of the resistance in the following.

In the closed state of the cylinder lock in accordance with the invention, the explained lock picking is now made more difficult in that a second change of the resistance is realized, which occurs additionally to the explained first change of the resistance, by a catching (e.g. springing back) engagement of a latch tip of the latch element into a latch catching recess of the associated disk tumbler on the displacement of the disk tumbler. On an attempt to probe the codings, there is thus the lack of clarity as to which change of the resistance (first change or second change) is currently being probed on the manipulative displacement of the disk tumbler, i.e. whether the currently probed change of the movement resistance is actually caused by the reaching of the unlatched position of the disk tumbler. The respective disk tumbler can thus admittedly be displaced out of the latched position in the direction of the unlatched position in the closed state of the cylinder lock (even when simultaneously a torque is exerted onto the cylinder core in the rotary direction of opening). However, for this purpose, a plurality of latch locks, and thus a plurality of changes of the movement resistance, have to be overcome between the latch element and the disk tumbler since the latch tip slides along the respective longitudinal side of the disk tumbler and in so doing catchingly engages into the latch catching recess and into the latch reception recess. The probing of the unlatched position of the disk tumbler by means of a lock-picking tool is hereby made more difficult.

The latch catching recess is provided adjacent to the latch reception recess into which the latch tip of the latch element engages when all of the disk tumblers associated with the latch element are in their unlatched position and the latch element can thus adopt the release position. In thus connection, "adjacent" is to be understood as an arrangement in which the latch catching recess is admittedly (necessarily) separate from the latch reception recess and is thus spaced apart from the latch reception recess by an intermediate elevated portion. The spacing between the latch catching recess and the latch reception recess is, however, smaller than the displacement path of the respective disk tumbler (spacing between the latched position and the unlatched position) so that on a probing of a changed movement resistance, the explained lack of clarity remains as to whether the respective disk tumbler is actually in the unlatched position. The at least one latch catching recess can in particular be adjacent to the latch reception recess of the respective disk tumbler such that the width of an intermediate elevated portion provided between the latch catching recess and the latch reception recess is smaller than the clearance of the latch reception recess and is preferably also smaller than the clearance of the latch catching recess.

The catching engagement of the latch tip of the latch element into the latch catching recess of the disk tumbler is thus established directly when the at least one disk tumbler is displaced relative to the unlatched position, wherein the latch catching recess at the disk tumbler is less deep than the latch reception recess (with respect to the direction of movement of the preloaded latch element). The length of the latch element is selected in this respect such that, when the at least one disk tumbler is at least partly in the latched position, the latch tip of the latch element can, on the one hand, engage catchingly into the latch catching recess of the disk tumbler and, on the other hand, the blocking section of the latch element nevertheless engages into the latch blocking recess of the cylinder housing. Since the latch catching recess is less deep than the latch reception recess of the disk tumbler, it is thus achieved that the latch element maintains its blocking position even when the latch tip engages into the latch catching recess (and not into the latch reception recess). The clearance of the latch catching recess (that is the opening width along the direction of displacement of the disk tumbler) is preferably also smaller than the clearance of the latch reception recess.

In accordance with a desired embodiment and with required safety aspects, a plurality of tumbler blocking recesses and latch blocking recesses can naturally be provided in addition to the one tumbler blocking recess and to the one latch blocking recess, with a plurality of latch elements also correspondingly being possible.

It must still be mentioned for a better understanding that the invention is described to a large extent with reference to at least one disk tumbler since the invention can generally already be realized by a cooperation of the latch element with a single disk tumbler. One respective latch element is, however, preferably associated with a group of some disk tumblers. In this case, the cooperation of the latch element, in particular the described engagement of the latch tip into the latch reception recess or the engagement of the latch tip into the latch catching recess, takes place with at least one of the disk tumblers from the associated group, in particular with that disk tumbler which is brought into the unlatched position last. It may, for example, be that the latch tip of the latch element which contacts a plurality of disk tumblers only engages partly into the latch catching recess of a specific disk tumbler, namely when the other disk tumblers are displaced by a specific path length with respect to the one specific disk tumbler.

Advantageous embodiments of the invention are named in the following and in the dependent claims.

In accordance with an advantageous embodiment, the at least one disk tumbler has, adjacent to the latch reception recess, a plurality of latch catching recesses arranged next to one another. It is hereby insured that a plurality of resistance changes—that is not only the explained first and second changes of the movement resistance—can be caused during a manipulative displacement of the disk tumbler along a wide displacement range by the catching engagement of the latch tip of the latch element into the respective latch catching recess. The unlatched position of the disk tumbler can hereby be probed with even more difficulty. So many latch catching recesses can advantageously be arranged next to one another adjacent to the latch reception recess that the latch tip of the latch element always catchingly engages into a latch catching recess of the disk tumbler for every possible position of the disk tumbler outside the unlatched position.

In accordance with a further advantageous embodiment, the disk tumbler has a respective at least one latch catching recess at both sides of the latch reception recess, i.e. not only at one single side of the latch reception recess. This is in particular of advantage when the disk tumblers are preloaded in opposite senses between one another, i.e. in two mutually opposed directions, or when the disk tumbler is displaceable such that the latch tip of the latch element can be at both sides of the latch reception recess of the disk tumbler and can act on the disk tumbler. Yet a further change of the movement resistance above all also hereby results when the respective disk tumbler is moved beyond the latched position on the attempt of a probing of the unlatched position.

In accordance with a further advantageous embodiment, the disk tumbler has a respective plurality of latch catching recesses arranged next to one another at both sides of the latch reception recess. It can hereby be insured that the above-explained resistance changes on the displacement of the disk tumblers along a wide displacement range are realized at both sides of the latch reception recess by a catching engagement of the latch tip into the respective latch catching recess, whereby the security against lock picking is increased.

The latch reception recess is advantageously provided at a side edge of the disk tumbler with respect to the direction of movement of the disk tumbler, the side edge preferably extending in parallel with the direction of displacement of the disk tumbler. A displacement of the disk tumbler is hereby brought about which is low in friction loss and is thus reliable on a contact of the latch tip of the latch element at the side edge. A plurality of disk tumblers arranged next to one another can furthermore contact the latch tip in a space-saving manner, whereby a compact size for the cylinder core can be achieved.

In accordance with a further advantageous embodiment, the latch reception recess and the latch catching recess are (at least) substantially formed as triangular. A substantially triangular recess is in particular still present when the outline of the recess is formed as an obtuse tip and/or with curved flanks. A stable shape match between the respective recess and the latch element engaging into the respective recess is achieved, on the one hand, by the substantially triangular configuration; on the other hand, the stable shape matching can be simply cancelled by a displacement of the disk tumblers by a suitable force (for example by means of the associated key), whereby the latch element is urged out of the respective recess against its preload.

In accordance with a further advantageous embodiment, an intermediate elevated portion is provided between the latch reception recess and the latch catching recess of the disk tumbler, wherein the latch tip has an intermediate recess and wherein the intermediate elevated portion of the disk tumbler is adapted to engage into the intermediate recess of the latch tip when the disk tumbler is displaced out of the unlatched position by a second path length (which corresponds to the engagement of the latch tip into the latch catching recess). It is insured in a simple manner by this feature that the latch tip of the latch element enters into a further catching shape-matched connection with the disk tumbler, namely already directly after the latch element has been urged out of the latch reception recess by the relatively small second path length by displacement of the disk tumbler. A further (i.e. third) change of the movement resistance of the disk tumbler is hereby effected on its displacement due to the temporary latch connection hereby caused, namely as soon as the disk tumbler is no longer in the unlatched position. The desired security against picking is therefore insured particularly well by this feature.

In accordance with a particularly simple embodiment, the intermediate recess of the latch tip can be formed as a groove which preferably extends in parallel with the axis of rotation of the cylinder core, in particular when the latch element is elongate and is associated with a group of some disk tumblers along the axis of rotation of the cylinder core. Such a groove can be formed in a straight line. The groove can, however, alternatively also not be in a straight line, but rather arcuate, for example. Alternatively or additionally, such a groove can also extend obliquely to the axis of rotation of the cylinder core. A greater variation of the engagement possibilities between the groove and the latch catching recess or the intermediate elevated portion of the disk tumbler can be achieved by such modifications, which increases the security against picking.

In accordance with a further advantageous embodiment, the latch element has a connection section between the latch tip and the blocking section, which connection section is narrower along a tangential direction viewed about the axis of rotation of the cylinder core than the blocking section of the latch element, i.e. the connection section is tapered in the manner of a neck. The possibility of a direct rotational clearance of the cylinder core relative to the cylinder housing hereby results which can advantageously increase the security against picking, as will be explained in more detail in the following.

In accordance with an advantageous embodiment, the connection section of the latch element is set back or set back less far at one side, which faces in a rotary direction of opening of the cylinder core, with respect to the blocking section of the latch element than at another (oppositely disposed) side which faces against the rotary direction of opening of the cylinder core. The side of the connection section facing in the rotary direction of opening of the cylinder core can in particular be planar and can end flush with the blocking section of the latch element, with the other side of the connection section being of oblique form and/or being set back with respect to the blocking section. The rotary clearance of the cylinder core to be explained in the following is hereby promoted.

The connection section of the latch element at the one side which faces in the rotary direction of opening of the cylinder core can in particular end flush with the blocking section of the latch element and can be set back with respect to the blocking section at the other side which faces against the rotary direction of opening of the cylinder core so that the blocking section only forms a lateral projection at the named other side. Such a lateral projection can have the effect on a manipulation attempt in which the cylinder core is acted on by a torque in the rotary direction of opening that the latch element remains in its blocking position and thus prevents a manipulative rotation of the cylinder core since the lateral projection is in this respect urged over the outer jacket surface of the cylinder core. Since no such lateral projection and accordingly no setback is provided at the named one side which faces in the rotary direction of rotation of the cylinder core, the manipulative rotational movement effects the desired displacement of the lateral projection over the outer jacket surface of the cylinder core at an early stage.

In accordance with a preferred embodiment, a holding plate is associated with the latch element which has a support opening which is penetrated by the connection section of the latch element when the latch element is in the blocking position. Provided that the at least one disk tumbler is in the latched position and the latch element is in the blocking position, there is a first rotary clearance, with respect to a rotary actuation of the cylinder core relative to the cylinder housing, between the blocking section of the latch element and the latch blocking recess of the cylinder housing. There is furthermore in the aforesaid state a second rotary clearance between the connection section of the latch element and the support opening of the associated holding plate. There is a third rotary clearance between the engagement section of the at least one disk tumbler and the tumbler blocking recess of the cylinder housing. In this embodiment, the first rotary clearance is smaller than the second rotary clearance and the second rotary clearance is in turn smaller than the third rotary clearance.

It is achieved by the quantitative differences in the rotary clearances configured in this manner that the latch element can tilt or cant easily between the latch reception recess and the holding plate when the blocking section of the latch element engages into the latch blocking recess of the cylinder housing and a torque is exerted onto the cylinder core in a rotary direction of opening (in particular in the case of a manipulation attempt). The catching engagement of the latch tip of the latch element with the latch catching recess of the disk tumbler is nevertheless maintained, whereby the explained second change of the resistance is maintained on the displacement of the disk tumbler despite a canting of the latch element and an association of the probed movement resistance to a fixed position of the disk tumbler is made more difficult. Since the first and second rotary clearances are smaller than the third rotary clearance, it is additionally prevented that the boundaries of the tumbler blocking recess can be utilized to bring the disk tumblers sequentially into the unlatched position in accordance with the above-explained method of "setting", whereby the security against picking is increased even further.

The latch element is preferably supported in a linearly (i.e. straight line) displaceable manner. The latch element is preferably displaceably supported in the radial direction with respect to the axis of rotation of the cylinder core.

In accordance with an advantageous embodiment, a holding plate, in particular the holding plate already named above, is arranged between the cylinder core and the cylinder housing, wherein a latch preloading device associated with the latch element is supported between the holding plate and the latch element. The holding plate is preferably received in a shape-matched manner and flush at the outside in a recess at the outer side of the cylinder core. The latch element can be preloaded particularly simply in the direction of the disk tumblers, in particular in the radially inwardly facing direction, by arranging the latch preloading device between the holding plate and the latch element, whereby it is insured that the latch tip of the latch element always contacts the respective disk tumbler and acts on it so that a stable shape matching is insured on an engagement of the latch tip into the latch reception recess or into the latch catching recess. The holding plate is preferably arched, wherein a support opening of the holding plate, in particular the support opening already named above, can be designed such that the blocking section of the latch element engages with shape matching into the support opening in the release position and forms an outwardly flush termination with the holding plate. The holding plate can be inserted into the recess in a freely floating manner at the outer side of the cylinder core (in particular with clearance), whereby an improved security against picking results due to a greater rotary clearance of the cylinder core. Alternatively to this, the holding plate can be pressed into the recess at the outer side of the cylinder core. A simpler assembly results by such a press fit and a snagging of the holding plate in the tumbler blocking recess of the cylinder housing on a rotational movement of the cylinder core (in the direction of the closed position) is reliably avoided.

In accordance with a further advantageous embodiment, each disk tumbler of a group which comprises some or all of the plurality of disk tumblers has a latch reception recess and at least one latch catching recess, wherein the latch element extends along the axis of rotation of the cylinder core and wherein the latch tip engages into a the latch reception recesses of the group of disk tumblers in the release position of the latch element. A single latch element can, for example, be associated with all the disk tumblers of the cylinder lock to cooperate therewith or a single latch element is associated with a subset of the disk tumblers (e.g. with every second one). Alternatively, a plurality of latch elements can be provided which are arranged axially behind one another and which act independently of one another. Two latch elements can furthermore be provided which can be arranged diametrically opposite with respect to the axis of rotation of the cylinder core. The respective rotary element can extend in parallel with or obliquely to the axis of rotation of the cylinder core and it can be linear or non-linear (for example arcuate). Depending on which safety requirements the cylinder is to satisfy, a suitable complexity of the cylinder lock can be selected in the sense of the above-explained alternatives.

In accordance with a preferred embodiment, the plurality of disk tumblers are preloaded into the respective latched position along a first preload direction, wherein the latch element is preloaded into the release position along a second preload direction and wherein the first preload direction and the second preload direction extend perpendicular or obliquely to one another. In this respect, the first preload direction can be directed radially outwardly with respect to the axis of rotation of the cylinder core, whereby the respective engagement sections of the disk tumblers generally, i.e. in their base position, engage into the tumbler blocking recess of the cylinder housing and latch the cylinder core with respect to a rotation. In contrast, the second preload direction, i.e. the preload direction of the latch element, is directed radially inwardly, whereby a second functionality of the latch element is insured. On the one hand, the latch element should, as already explained, enter into a catching shape match with the latch catching recess of the disk tumbler to realize a second resistance on the displacement of the disk tumbler. On the other hand, the radially inwardly directed second preload direction serves the purpose that the latch element automatically engages into the latch reception recess of the disk tumbler when the disk tumbler is in its unlatched position, whereby the blocking section of the latch element is brought out of engagement with the latch blocking recess and the cylinder core can be rotated in the cylinder housing. As already mentioned further above, the disk tumblers can be preloaded in opposite senses among one another, i.e. in two mutually opposite directions.

Alternatively or additionally, the plurality of disk tumblers are preloaded into the latched position by means of a respective tumbler preloading device, wherein the latch element is preloaded into the release position by means of a latch preloading device and wherein the tumbler preloading devices and the latch reception recess of the at least one disk tumbler and the latch preloading device and the latch tip of the latch element are coordinated with one another so that the disk tumblers adopt their respective latched position in a closed position of the cylinder core and the disk tumbler or disk tumblers which has or have a latch engagement recess hereby urges or urge the latch element into the blocking position. In other words, the tumbler preloading devices have the effect in a base position of the cylinder lock that the disk tumblers adopt their respective latched position, wherein the latch element is urged into the blocking position against its preload due to the preloading effect and to the shape of the latch reception recess of the respective disk tumbler or disk tumblers. The cylinder core is thus latched against a rotational movement in the base position.

In accordance with a further advantageous embodiment, each of the plurality of disk tumblers has a key introduction opening whose outline has a first coding section and a second coding section. Matched to this, a key associated with the cylinder lock (in particular on a first side of a central plane) has a sequence of first incisions which correspond to the first coding sections of the plurality of disk tumblers. The key equally has (in particular on a second side of the central plane) a sequence of second incisions which correspond to the second coding sections of the plurality of disk tumblers. Due to this embodiment, the movement space in the keyway, which is formed by the key introduction openings of the disk tumblers, is reduced with respect to a simple substantially rectangular design of the keyway for possible manipulation attempts, i.e. the probing of the codings of the disk tumblers is hereby made more difficult. More closing variants furthermore result from the above-explained two-stage aspect of the key, whereby the security against picking is increased with respect to a false key since the two coding sections for each disk tumbler have to be correctly polled. There is furthermore a reduced probability that a key which is not associated with the cylinder lock can be introduced into the keyway at all.

The invention will be described in the following only by way of example with reference to the drawings.

FIG. 2 shows the cylinder lock from the rear, with the cylinder core (FIG. 2*b*) having been removed from the cylinder housing (FIG. 2*a*);

Figure 1:
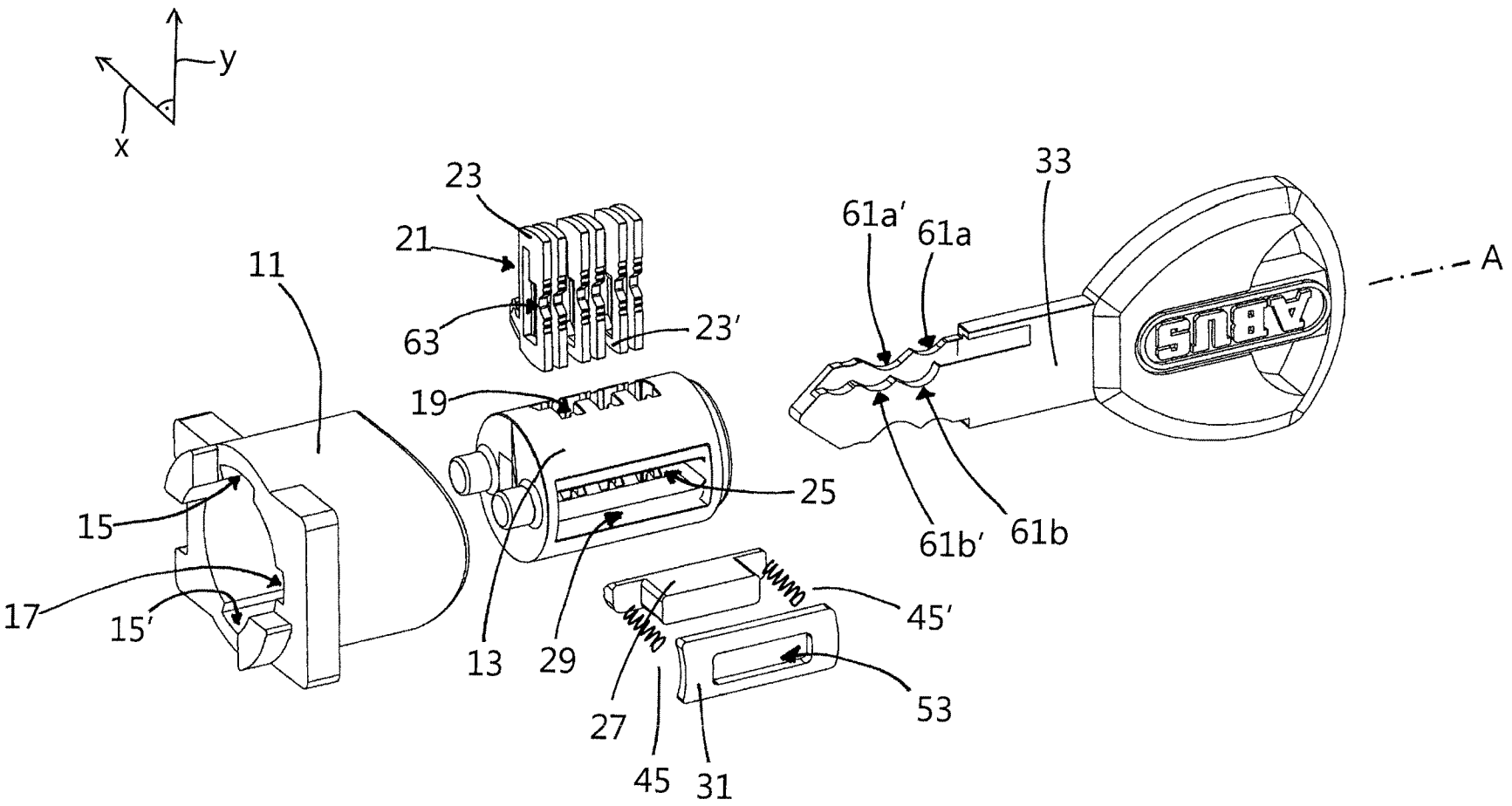
FIG. 1 shows a cylinder lock in an exploded view.

The design of the shown cylinder lock will first be described with reference to FIG. 1. The lock has a cylinder housing 11 and a cylinder core 13 rotatable therein, wherein the cylinder housing 11 has tumbler blocking recesses 15, 15' and a latch blocking recess 17. The cylinder core 13 has, at its upper side and at its lower side (not shown), tumbler openings 19 for receiving disk tumblers 21. Furthermore, a latch reception opening 25 for receiving a latch element 27 and a holding plate reception recess 29 for receiving a holding plate 31 are provided laterally at the cylinder core 13. The cylinder lock can be opened and closed by means of an associated key 33, with the cylinder core 13 being rotatable about an axis of rotation A.

Figure 3:
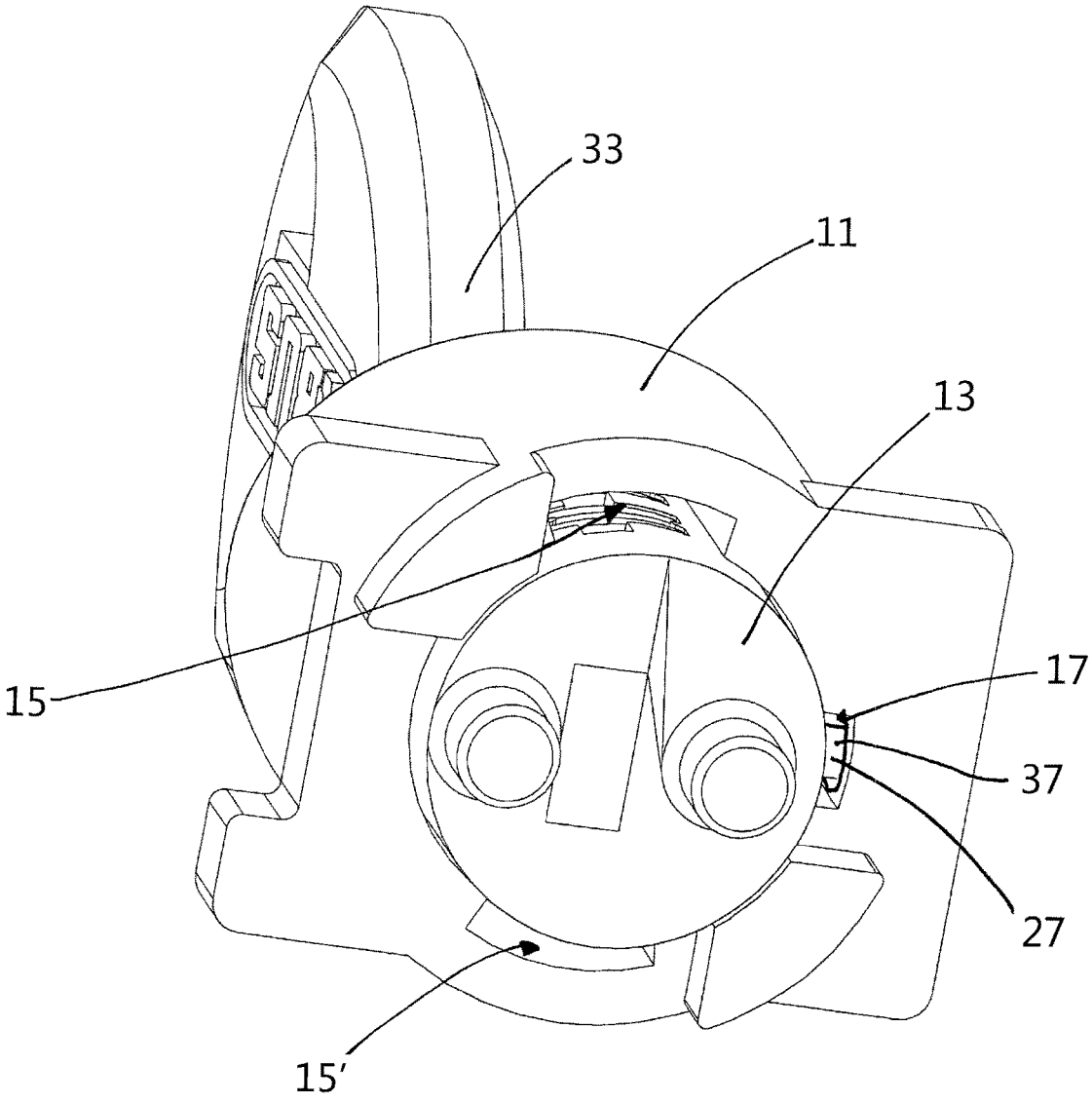
FIG. 3 shows the cylinder lock from the rear, with the cylinder core having been inserted into the cylinder housing.

In FIG. 2*b*, the cylinder core 13 is shown with the key 33 introduced therein, with the disk tumblers 21, the holding plate 31 and the latch element 27 being received in the cylinder core 13. In FIG. 2*a*, the cylinder housing 11 is illustrated, with the substantially circular cross-section of the inner jacket surface of the cylinder housing 11 being interrupted by diametrically opposite tumbler blocking recesses 15, 15' and the latch blocking recess 17 arranged offset by 90° therefrom. In FIG. 3, the cylinder housing 11 is shown with the cylinder core 13 received therein, wherein a blocking section 37 of the latch element 27 engages into the latch blocking recess 17.

Figure 4:
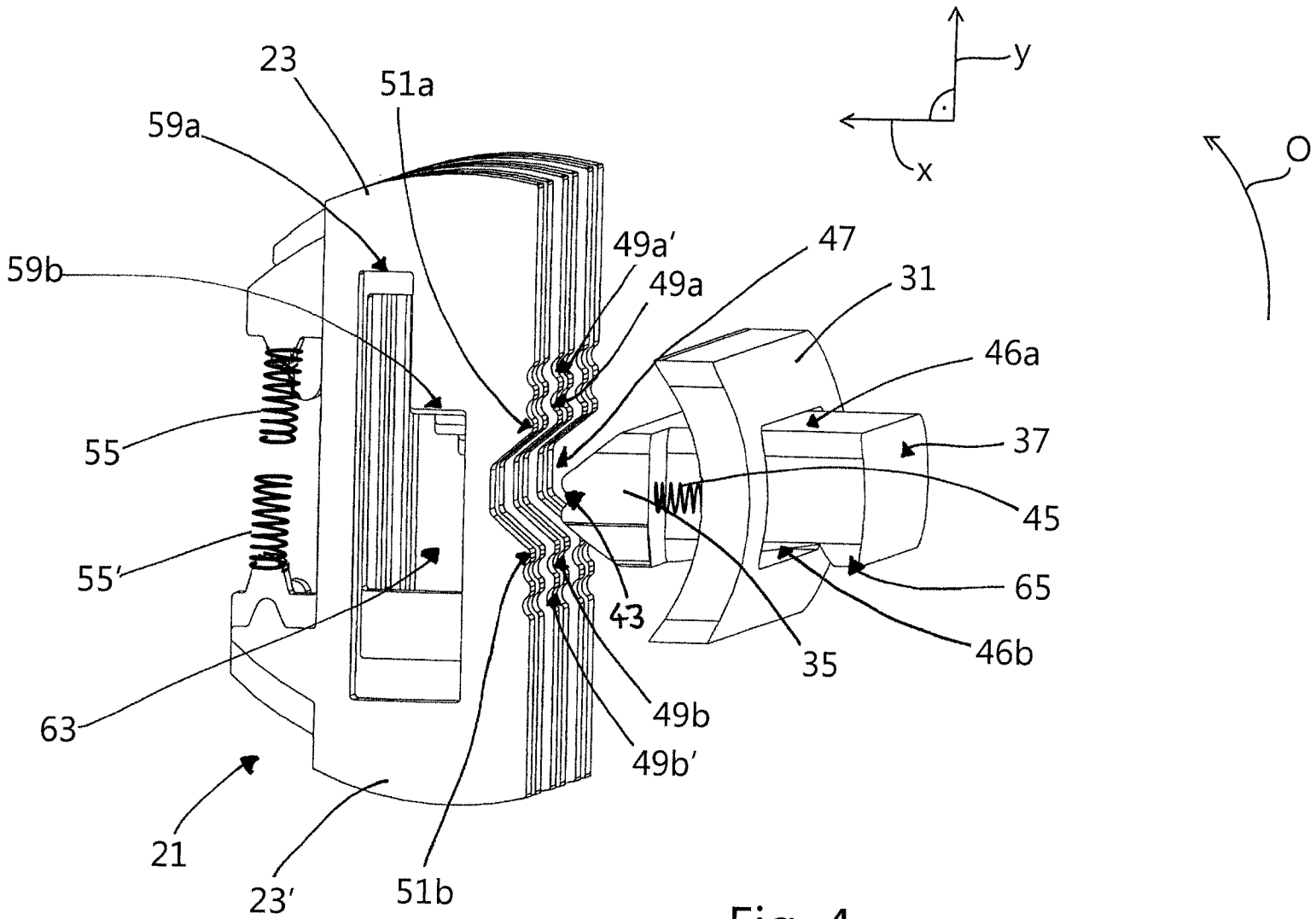
FIG. 4 shows a perspective view of a group of disk tumblers as well as a latch element guided by a holding plate.

The disk tumblers 21 are movable in the cylinder core 13 along a preload direction Y shown in FIGS. 1 and 4 between a latched position and an unlatched position, wherein the disk tumblers 21, as shown in FIG. 4, are preloaded along the preload direction Y by means of disk tumbler springs 55, 55'. Groups of disk tumblers 21 are in this respect preloaded in opposite senses in the embodiment shown, i.e. one group of disk tumblers 21 is preloaded in the preload direction Y by means of disk tumbler springs 55 so that the respective engagement section 23 engages into the tumbler blocking recess 15 of the cylinder housing 11 in the latched position; another group of disk tumblers 21 is preloaded against the preload direction Y by means of disk tumbler springs 55' so that the respective engagement section 23' engages into the tumbler blocking recess 15' of the cylinder housing 11. Each disk tumbler 21 is formed in one piece and has a key introduction opening 63 (FIG. 4).

As is shown in FIG. 4, the disk tumblers 21 has, at an outer longitudinal side, a respective latch reception recess 47 which is provided for receiving a latch tip 35 of the latch element 27. Adjacent to the latch reception recess 47, latch catching recesses 49*a*, 49*a'*, 49*b* and 49*b'* are provided at both sides, wherein the latch catching recesses 49*a* and 49*a'* are arranged above the latch reception recess 47 in the preload direction Y and the latch catching recesses 49*b* and 49*b'* are arranged beneath the latch reception recess 47 (against the shown preload direction Y). An Intermediate elevated portion 51*a* is furthermore provided between the latch reception recess 47 and the latch catching recess 49*a*. In the same way, an intermediate elevated portion 51*b* is provided between the latch reception recess 47 and the latch catching recess 49*b*. The latch catching recesses 49*a*, 49*a'*, 49*b* and 49*b'* are designed for a catching engagement of the latch tip 35 of the latch element 27 when the respective disk tumbler 21 is displaced relative to its unlatched position (FIG. 6*b*). The latch catching recesses 49*a*, 49*a'*, 49*b* and 49*b'* are less deep than the latch reception recess 47.

Figure 5:
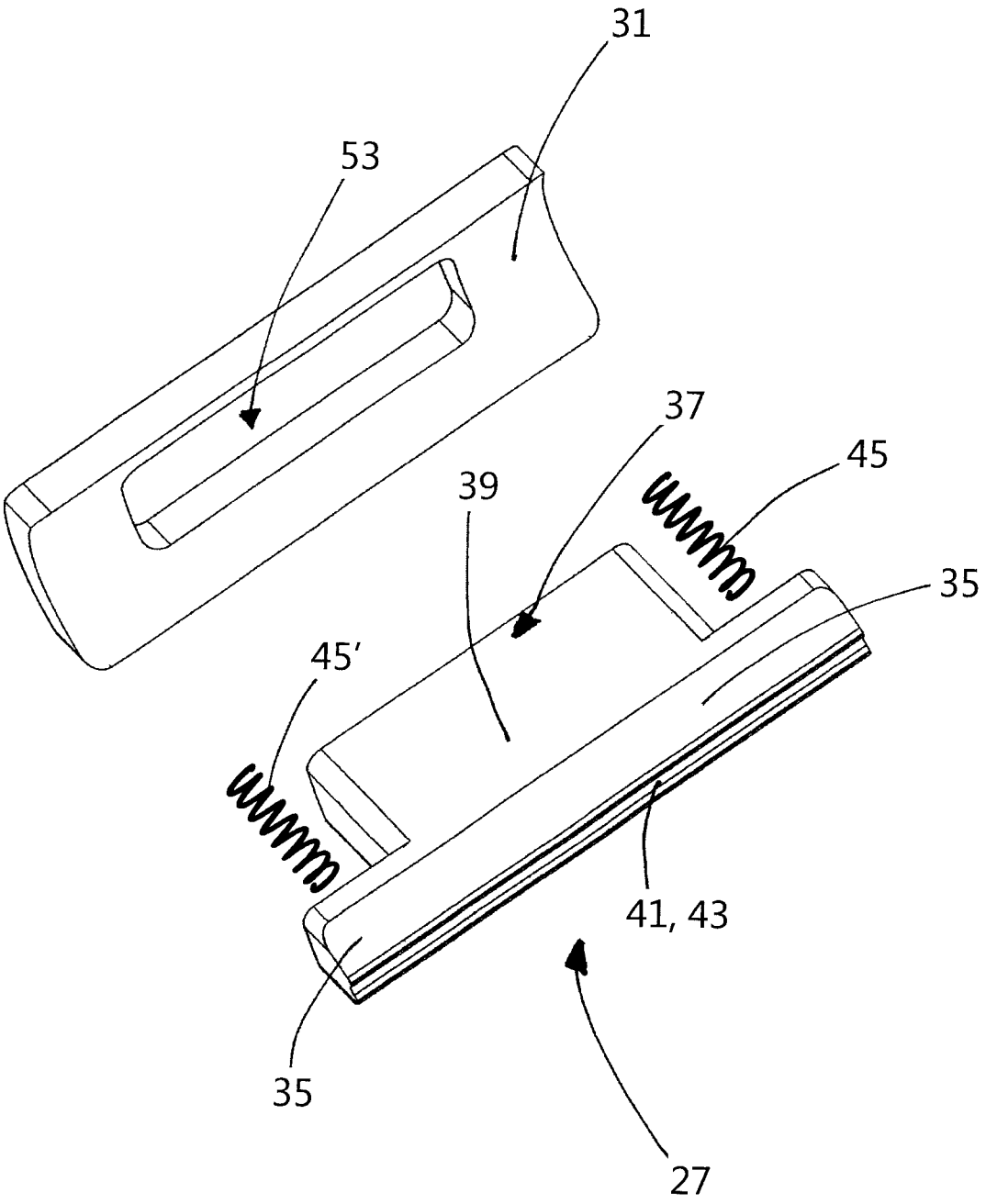
FIG. 5 shows the holding plate and the latch element in a further exploded view.

As shown in FIG. 5, the latch tip 35 of the latch element 27 and the blocking section 37 of the latch element 27 are connected to one another by means of a connection section 39. The latch tip 35 has a groove 41 at its front side which satisfies the function of an intermediate recess 43. The latch element 27 is preloaded into a preload direction X of the latch element 27 by means of a latch preloading device comprising latch element springs 45, 45' (FIG. 4), wherein the latch element springs 45, 45' are located between the latch tip 35 and the holding plate 31 at both sides of the connection section 39 (FIG. 5 and FIG. 1). The preload direction X of the latch element 27 extends perpendicular to the preload direction Y of the disk tumblers 21 in the embodiment shown here. Alternatively to this, the respective directions of movement and accordingly the two preload directions X, Y can, however, also extend obliquely to one another.

As shown in FIG. 4, the latch element 27 is guided by a support opening 53 of the holding plate 31, wherein the blocking section 37 is located in the radially outwardly disposed region of the holding plate 31; the latch tip 35 of the latch element 27 is located at the other end in the radially inner region, i.e. within the cylinder core 13, wherein the outlines of the cylinder core 13 are not drawn in FIG. 4 for the purpose of better visibility of the parts located in the cylinder core 13. It is furthermore shown in FIG. 4 that the connection section 39 of the latch element 27 is not set back or is set back less at a side 46*a* which faces in a rotary direction of opening O of the cylinder core 13, with respect to the blocking section 37 of the latch element 27, than at another side 46*b* which faces against the rotary direction of opening O of the cylinder core 13. In the embodiment shown here, the surface 46*b* is chamfered with respect to the planar surface 46*a*. The blocking section 37 of the latch element 27 thus forms a lateral projection 65 at the side 46*b*, the lateral projection protruding beyond the side 46*b* or the chamfered surface 46*b*.

Figure 6A:
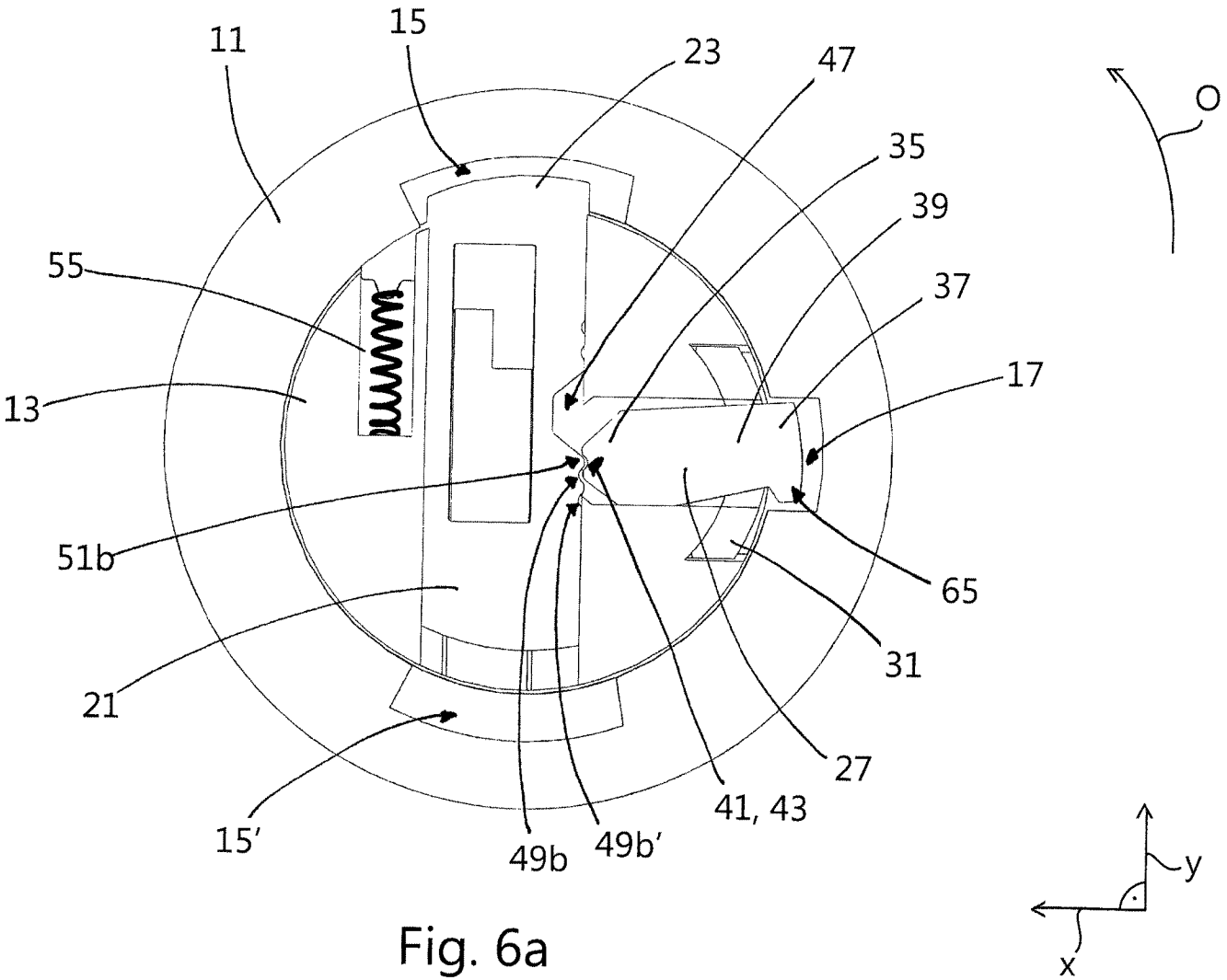
FIG. 6*a* and FIG. 6*b* show the cylinder lock in a latched state (FIG. 6*a*) and in an unlatched state (FIG. 6*b*), with both drawings representing a cross-sectional view of the cylinder lock.
Figure 6B:
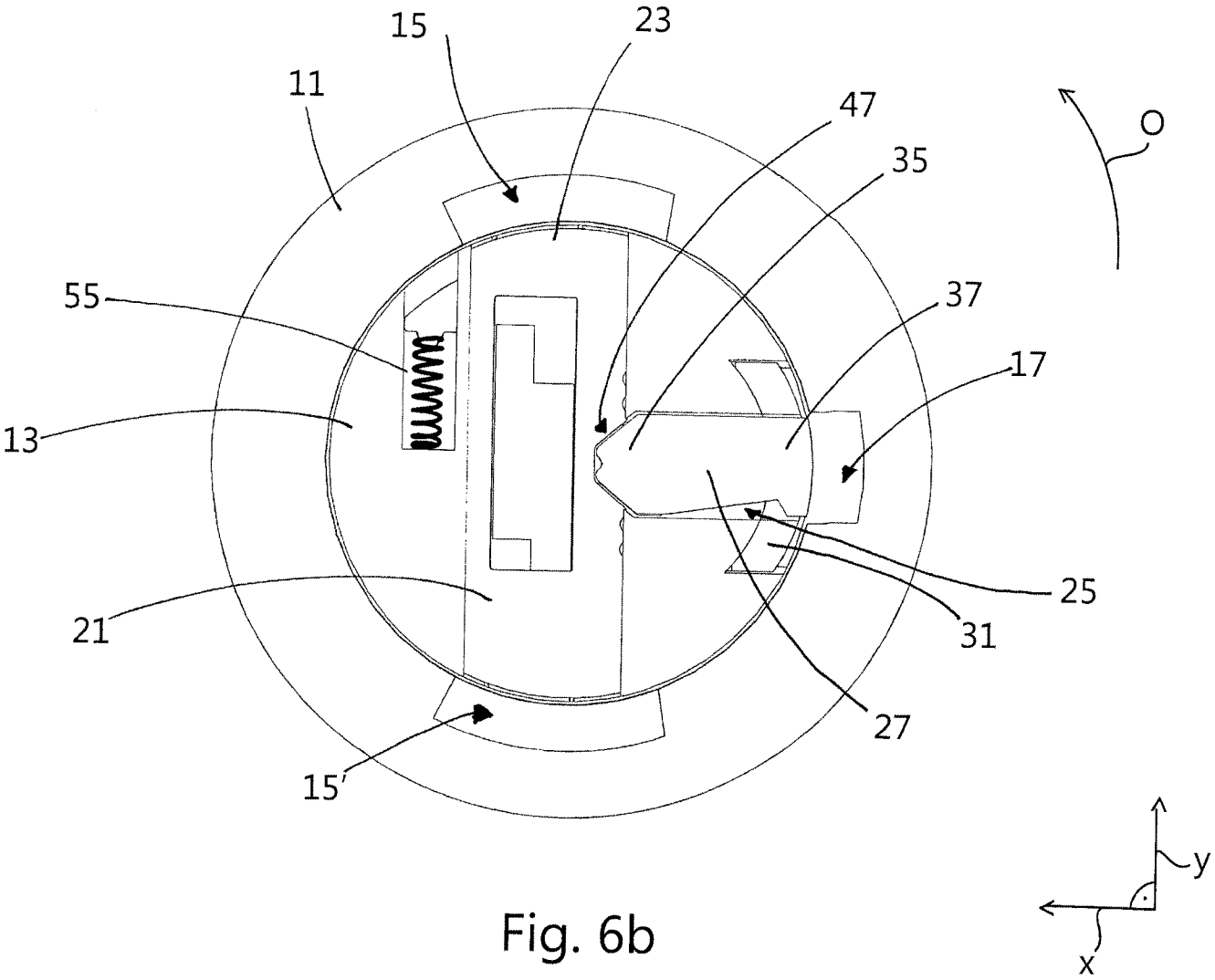

On a manipulation attempt in the form of picking, in which the cylinder core 13 is preloaded in the rotary direction of opening O (that is when the cylinder core 13 is moved counter-clockwise beyond the shown rotational position with respect to the representation in accordance with FIG. 6*a*), the lateral projection 65 has the effect that the latch element 27 remains in its blocking position even if all the disk tumblers 21 are in their unlatched position (in accordance with FIG. 6*b*) due to a successively taking place "setting" and the latch tip 35 of the latch element 27 can thus engage into the latch reception recesses 47 of all the disk tumblers 21. In this state, the lateral projection 65 of the blocking section 37 namely engages over the outer periphery of the cylinder core 13 or of the holding plate 31, whereby the blocking section 37 of the latch element 27 continues to engage into the latch blocking recess 17 of the cylinder housing 11 and prevents a rotation of the cylinder core 13 about the axis of rotation A (FIG. 1).

The general operation of the shown cylinder lock will be explained in the following mainly with reference to FIGS. 6*a* and 6*a*.

The cylinder core 13 is only rotated in the cylinder housing 11 between a closed position and an open position.

FIG. 6*a* shows the lock in a closed state which is initially characterized in that at least one of the disk tumblers 21 (in the base position of the cylinder lock: each of the disk tumblers 21) is located in the latched position. In the cross-sectional value shown in FIG. 6*a*, the engagement section 23 of the disk tumbler 21 shown at the very front engages into the tumbler blocking recess 15, whereby the cylinder core 13 is latched with respect to a rotation about the axis of rotation A, apart from a small rotary clearance (FIG. 1). Since the disk tumbler 21 is at least partly in the latched position, the latch element 27 is displaced against the preload direction X such that the blocking section 37 of the latch element 27 engages into the latch blocking recess 17 and additionally blocks the cylinder core 13 with respect to a rotation of the cylinder core 13 about the axis of rotation A, apart from an even smaller rotary clearance (FIG. 1).

In order better to illustrate the special operation of the shown cylinder lock with respect to the making more difficult of a probing of the codings of the disk tumblers 21, the engagement section 23 of the disk tumbler 21 shown at the very front in the representation in accordance with FIG. 6*a* is not completely introduced into the tumbler blocking recess 15, i.e. this disk tumbler 21 is not completely located in its latched position. The latch element 27, in contrast, is located in its blocking position in the representation in accordance with FIG. 6*a*. In the state shown, the latch tip 35 catchingly engages partly into the latch reception recess 47 and partly into the latch catching recess 49*b* and the intermediate elevated portion 51*b* of the disk tumbler 21 engages into the intermediate recess 43 of the latch tip 35. If, in contrast, the engagement section 23 of the respective disk tumbler 21 is completely introduced into the tumbler blocking recess 15, i.e. if this disk tumbler 21 is completely in its latched position, the latch tip 35, deviating from the representation in accordance with FIG. 6*a*, only engages into the latch catching recesses 49*b*, 49*b*', but no longer into the latch reception recess 47.

The cylinder lock is shown in the open state in FIG. 6*b*. The open state is initially characterized in that all the disk tumblers 21 are in the unlatched position, i.e. none of the engagement sections 23, 23' of the disk tumblers 21 engage into the tumbler blocking recesses 15, 15' of the cylinder housing 11. In this fully unlatched position of the disk tumblers 21, the latch tip 35 of the latch element 27 is completely received in the latch reception recess 47 of the respective disk tumbler 21, whereby the blocking section 37 of the latch element 27 no longer engages into the latch blocking recess 17 of the cylinder housing 11, but is rather received in the support opening 53 of the holding plate 31. The latch element 27 is accordingly in its release position. Provided that all the disk tumblers 21 are in their unlatched positions and the latch element 27 is thereby also in its release position, the cylinder core 13 can be rotated freely about the axis of rotation A (FIG. 1).

To move all the disk tumblers 21 into their unlatched positions, the key 33 is introduced into the keyway of the cylinder lock which is formed by the key introduction openings 63 aligned with one another (FIG. 1 and FIG. 4) of the disk tumblers 21. The outline of the respective key introduction opening 63 has a first coding section 59*a* and a second coding section 59*b* (FIG. 4). The key 33 accordingly has at a first side of a central plane a sequence of first incisions 61*a*, 61*a*' (FIG. 1) which correspond to the first coding sections 59*a* of the disk tumblers 21. At a second side of the central plane, the key 33 has a sequence of second incisions 61*b*, 61*b*' which correspond to the second coding sections 59*b* of the disk tumblers 21. During the introduction of the key 33 into the keyway, the incisions 61*a*, 61*a*', 61*b*, 61*b*' slide along the coding sections 59*a*, 59*b* of the disk tumblers 21, whereby the disk tumblers 21 are displaced out of their latched position against their respective preload. The latch tip 35 of the latch element 27 in this respect slides along the longitudinal side of the respective disk tumbler 21 and successively first catchingly engages into the latch catching recesses 49*b*, 49*b*' (or 49*a*, 49*a*') and finally into the latch reception recess 47.

If an attempt is made in the shown cylinder lock to probe the displacement path in accordance with the method of the probing of the codings, which displacement path the respective disk tumbler 21 covers between the latched position and the unlatched position, there is a considerable difficulty in that a plurality of tangible changes of the movement resistance can occur as a consequence of the mutual catching engagement between the latch tip 35 (including the intermediate recess 42) and the latch catching recesses 49*a*, 49*a*', 49*b*, 49*b*' and the intermediate elevated portions 51*a*, 51*b* along a far displacement range. It can thus not be determined or can only be determined with great difficulty in which position of the manipulatively displaced disk tumbler 21 the unlatched position is actually reached in which the latch tip 35 engages into the latch reception recess 47. A high security against picking is thus achieved.

Three specific rotary clearances exist overall in FIG. 6*a* with respect to a rotary actuation of the cylinder core 13; A first rotary clearance exists between the blocking section 37 of the latch element 27 and the latch blocking recess 17 of the cylinder housing 11; a second rotary clearance exists between the connection section 39 of the latch element 27 and the support opening 53 of the holding plate 31; and a third rotary clearance exists between the engagement section 23 of the at least one disk tumbler 21 and the tumbler blocking recess 15 of the cylinder housing 11. The first rotary clearance is selected as smaller than the second rotary clearance and the second rotary clearance is selected as smaller than the third rotary clearance. The latch element 27 can hereby tilt or cant easily when a torque is exerted onto the cylinder core 13 in the rotary direction of opening, while the blocking section 37 of the latch element 27 engages into the latch blocking recess 17 of the cylinder housing 11. An association of the probed movement resistance with a specific position of the disk tumbler 21 is thus made even more difficult.

REFERENCE NUMERAL LIST

11 cylinder housing
13 cylinder core

15, 15' tumbler blocking recesses
17 latch blocking recess
19 tumbler openings
21 disk tumblers
23, 23' engagement section
25 latch reception opening
27 latch element
29 holding plate reception recess
31 holding plate
33 key
35 latch tip
37 blocking section
39 connection section
41 groove
43 intermediate recess
45, 45' latch element springs
46*a*, 46*b* sides
47 latch reception recess
49*a*, 49*a'*, 49*b*, 49*b'* latch catching recesses
51*a*, 51*b* intermediate elevated portions
53 support opening
55, 55' disk tumbler springs
59*a* first coding section
59*b* second coding section
61*a*, 61*a'* first incisions
61*b*, 61*b'* second incisions
63 key insertion opening
65 lateral projection
A axis of rotation
Y preload direction of the disk tumblers
X preload direction of the latch element
O rotary direction of opening of the cylinder core

The invention claimed is:

1. A cylinder lock having a cylinder housing and a cylinder core rotatably supported in the cylinder housing, wherein the cylinder housing has at least one tumbler blocking recess and a latch blocking recess;

wherein a plurality of disk tumblers are provided in the cylinder core, with each of the plurality of disk tumblers having an engagement section and being movable between a latched position and an unlatched position, with the engagement section engaging into the tumbler blocking recess of the cylinder housing in the latched position and being brought out of engagement with the tumbler blocking recess in the unlatched position, and with at least one of the plurality of disk tumblers having a latch reception recess; and wherein the cylinder lock furthermore has a latch element which has a latch tip and a blocking section, with the latch element being movable between a blocking position and a release position and being preloaded into the release position, with the blocking section engaging into the latch blocking recess of the cylinder housing in the blocking position, and with the latch tip engaging into the latch reception recess of the at least one disk tumbler and the blocking section being brought out of engagement with the latch blocking recess of the cylinder housing in the release position, wherein the at least one disk tumbler has, adjacent to the latch reception recess, at least one latch catching recess into which the latch tip of the latch element catchingly engages when the at least one disk tumbler is displaced out of the unlatched position by a first path length, with the latch catching recess being less deep than the latch reception recess of the disk tumbler;

wherein the latch element has a connection section between the latch tip and the blocking section, the connection section being narrower with respect to a tangential direction about the axis of rotation of the cylinder core than the blocking section of the latch element;

wherein at one side, which faces in a rotary direction of opening of the cylinder core, the connection section of the latch element ends flush with the blocking section of the latch element, and wherein at another side, which faces against the rotary direction of opening of the cylinder core, the connection section of the latch element is set back with respect to the blocking section of the latch element so that a lateral projection is formed.

2. A cylinder lock in accordance with claim 1, wherein the at least one disk tumbler has, adjacent to the latch reception recess, a plurality of latch catching recesses arranged next to one another.

3. A cylinder lock in accordance with claim 1, wherein the at least one disk tumbler has a respective at least one latch catching recess at both sides of the latch reception recess.

4. A cylinder lock in accordance with claim 1, wherein the at least one disk tumbler has a respective plurality of latch catching recesses arranged next to one another at both sides of the latch reception recess.

5. A cylinder lock in accordance with claim 1, wherein the latch reception recess is provided at a side edge of the at least one disk tumbler with respect to the direction of movement of the at least one disk tumbler.

6. A cylinder lock in accordance with claim 1, wherein the latch reception recess and the at least one latch catching recess are substantially triangular.

7. A cylinder lock in accordance with claim 1, wherein the at least one disk tumbler has an intermediate elevated portion between the latch reception recess and the at least one latch catching recess, with the latch tip having an intermediate recess, and with the intermediate elevated portion of the at least one disk tumbler being adapted to engage into the intermediate recess of the latch tip when the at least one disk tumbler is displaced out of the unlatched position by a second path length which is smaller than the first path length.

8. A cylinder lock in accordance with claim 7, wherein the intermediate recess of the latch tip is formed as a groove which extends in parallel with the axis of rotation of the cylinder core.

9. A cylinder lock in accordance with claim 1, wherein a holding plate is arranged between the cylinder core and the cylinder housing, with a latch preloading device associated with the latch element being supported between the holding plate and the latch element.

10. A cylinder lock in accordance with claim 1, wherein each disk tumbler of a group which comprises some or all of the plurality of disk tumblers has a latch reception recess and at least one latch catching recess, with the latch element extending along the axis of rotation of the cylinder core, and with the latch tip engaging into the latch reception recesses of the group of disk tumblers in the release position of the latch element.

11. A cylinder lock in accordance with claim 1, wherein the plurality of disk tumblers are preloaded into the latched position along a first preload direction, with the latch element being preloaded into the release position along a second preload direction, and with the first preload direction and the second preload direction extending obliquely or perpendicular to one another.

12. A cylinder lock in accordance with claim 1, wherein the plurality of disk tumblers are preloaded into the latched position by means of a respective tumbler preloading device, with the latch element being preloaded into the release position by means of a latch preloading device, and with the tumbler preloading devices and the latch reception recess of the at least one disk tumbler and the latch preloading device and the latch tip of the latch element being coordinated such that, in a closed position of the cylinder core, the plurality of disk tumblers adopt the latched position and the at least one disk tumbler hereby urges the latch element into the blocking position.

13. A cylinder lock in accordance with claim 1, wherein each of the plurality of disk tumblers has a key introduction opening whose outline has a first coding section and a second coding section, with a key associated with the cylinder lock having a sequence of first incisions which correspond to the first coding sections of the plurality of disk tumblers and having a sequence of second incisions which correspond to the second coding sections of the plurality of disk tumblers.

14. A cylinder lock in accordance with claim 1, wherein the lateral projection is configured to be urged over an outer surface of the cylinder core when a torque in the rotary direction of opening of the cylinder core is exerted onto the cylinder core while the latch element is in the blocking position.

15. A cylinder lock having a cylinder housing and a cylinder core rotatably supported in the cylinder housing, wherein the cylinder housing has at least one tumbler blocking recess and a latch blocking recess;

wherein a plurality of disk tumblers are provided in the cylinder core, with each of the plurality of disk tumblers having an engagement section and being movable between a latched position and an unlatched position, with the engagement section engaging into the tumbler blocking recess of the cylinder housing in the latched position and being brought out of engagement with the tumbler blocking recess in the unlatched position, and with at least one of the plurality of disk tumblers having a latch reception recess;

and wherein the cylinder lock furthermore has a latch element which has a latch tip and a blocking section, with the latch element being movable between a blocking position and a release position and being preloaded into the release position, with the blocking section engaging into the latch blocking recess of the cylinder housing in the blocking position, and with the latch tip engaging into the latch reception recess of the at least one disk tumbler and the blocking section being brought out of engagement with the latch blocking recess of the cylinder housing in the release position, wherein the at least one disk tumbler has, adjacent to the latch reception recess, at least one latch catching recess into which the latch tip of the latch element catchingly engages when the at least one disk tumbler is displaced out of the unlatched position by a first path length, with the latch catching recess being less deep than the latch reception recess of the disk tumbler;

wherein the latch element has a connection section between the latch tip and the blocking section, the connection section being narrower with respect to a tangential direction about the axis of rotation of the cylinder core than the blocking section of the latch element;

wherein a holding plate is associated with the latch element and has a support opening, with the connection section of the latch element penetrating through the support opening when the latch element is in the blocking position;

wherein, when the at least one disk tumbler is in the latched position and the latch element is in the blocking position, a first rotary clearance exists between the blocking section of the latch element and the latch blocking recess of the cylinder housing with respect to a rotary actuation of the cylinder core, a second rotary clearance exists between the connection section of the latch element and the support opening of the associated holding plate, and a third rotary clearance exists between the engagement section of the at least one disk tumbler and the tumbler blocking recess of the cylinder housing; and wherein the first rotary clearance is smaller than the second rotary clearance and the second rotary clearance is smaller than the third rotary clearance.

16. A cylinder lock in accordance with claim 15, wherein the holding plate is arranged between the cylinder core and the cylinder housing, with a latch preloading device associated with the latch element being supported between the holding plate and the latch element.

* * * * *